US007458175B2

(12) United States Patent
Meyer et al.

(10) Patent No.: US 7,458,175 B2
(45) Date of Patent: Dec. 2, 2008

(54) RETRACTABLE DISPLAY APPARATUS

(75) Inventors: Allen Meyer, 13 Dreyfus St., Steeldale, 2197 Johannesburg (ZA); David Ivy, Johannesburg (ZA)

(73) Assignee: Allen Meyer, Johannesburg (ZA)

( * ) Notice: Subject to any disclaimer, the term of this patent is extended or adjusted under 35 U.S.C. 154(b) by 165 days.

(21) Appl. No.: 10/567,244

(22) PCT Filed: Aug. 4, 2004

(86) PCT No.: PCT/ZA2004/000093

§ 371 (c)(1),
(2), (4) Date: Dec. 18, 2006

(87) PCT Pub. No.: WO2005/013244

PCT Pub. Date: Feb. 10, 2005

(65) Prior Publication Data

US 2007/0070500 A1 Mar. 29, 2007

(30) Foreign Application Priority Data

Aug. 4, 2003 (ZA) ..... 03/5983

(51) Int. Cl.
*B42F 9/00* (2006.01)

(52) U.S. Cl. ..... 40/514; 359/461; 160/23.1; 160/15; 160/237; 242/271

(58) Field of Classification Search ..... 359/461; 40/493, 500, 514, 515, 575; 242/371, 376, 242/379, 379.2, 380, 398, 588, 588.3; 160/23.1, 160/15, 237

See application file for complete search history.

(56) References Cited

U.S. PATENT DOCUMENTS

| | | | | |
|---|---|---|---|---|
| 2,755,578 | A * | 7/1956 | Glacius | 40/500 |
| 3,018,824 | A * | 1/1962 | Anderson et al. | 160/394 |
| 4,458,739 | A * | 7/1984 | Murray et al. | 160/23.1 |
| 4,520,583 | A * | 6/1985 | Oka | 40/378 |
| 5,197,600 | A * | 3/1993 | Garcia | 206/308.3 |
| 5,798,861 | A * | 8/1998 | Doat | 359/461 |
| 6,249,377 | B1 | 6/2001 | Takamoto | |
| 6,876,493 | B1 * | 4/2005 | Lin | 359/461 |
| 7,185,690 | B2 * | 3/2007 | Johansson et al. | 160/24 |
| 7,337,822 | B2 * | 3/2008 | Snyder et al. | 160/23.1 |
| 2004/0020603 | A1 | 2/2004 | Johansson | |

FOREIGN PATENT DOCUMENTS

| | | |
|---|---|---|
| DE | 1 509 513 | 11/1969 |
| EP | 1 285 421 | 1/2004 |

* cited by examiner

*Primary Examiner*—Joanne Silbermann
*Assistant Examiner*—Shin Kim
(74) *Attorney, Agent, or Firm*—Gordon & Jacobson, PC

(57) ABSTRACT

A retractable display apparatus (10) comprises a housing (12), a drum (14) journalled for rotation in the housing, a display sheet (16) wound on to the drum, and a slot (22) in the housing through which the display sheet can be unwound from the drum against the action of a return spring, wherein a flexible leader strip (28) extendable through the slot is provided for releasably attaching the display sheet to the drum (14) in an easy and convenient manner outside the housing (12). The leader strip (28) has ribs (28.2) along both longitudinal edges, one rib being engageable with the drum and the other with an undercut formation (30) secured to the display sheet (16).

17 Claims, 1 Drawing Sheet

RETRACTABLE DISPLAY APPARATUS

TECHNICAL FIELD

This invention relates to a retractable display apparatus comprising a housing, a drum journalled for rotation in the housing, a display sheet wound on to the drum, a slot through which a display sheet can be unwound from the drum against the action of a return spring, and support means for holding the display sheet in an extended position. The invention is concerned primarily, though not exclusively, with such apparatuses for displaying promotional posters and the like.

BACKGROUND OF THE INVENTION

Various display apparatuses are known, such as that disclosed in U.S. Pat. No. 5,798,861. A disadvantage of many of the known devices is that it is difficult to change the display sheet, which of necessity is securely attached to the drum. European patent application 1,285,421 seeks to overcome this problem by providing an extruded strip along the edge of the display sheet, the strip being removably engageable with or in an attaching formation extending longitudinally on the periphery of the drum. Changing the sheet requires extending the display sheet fully, aligning the attaching formation with the slot and holding the drum against the bias of the return spring. Due to the perceived awkwardness of this operation, it is not uncommon for a user simply to order a complete new device with reprinted information or to return the device to the supplier to change the display sheet.

This invention seeks to provide and apparatus and method of using same which facilitates changing of the display sheet.

SUMMARY OF THE INVENTION

One aspect of the invention provides a retractable display apparatus comprising a housing, a drum journalled for rotation in the housing, a display sheet wound on to the drum, and a slot in the housing through which a display sheet can be unwound from the drum against the action of a return spring, wherein:

- a leader strip is attached to the drum along one edge, the leader strip being dimensioned to extend through the slot when the drum is unwound sufficiently;
- a first securing formation is provided on the leader strip spaced from the first mentioned edge, the first securing formation being dimensioned to pass through the slot; and
- a second securing formation is attached to the display sheet, the first and second securing formations being releasably engageable with each other.

This construction enables the display sheet and leader strip to be unwound from the drum such that the first and second securing formations are visible and easily accessible outside of the housing, the drum or strip then being held, the formations detached and a fresh display sheet provided with a second securing formation attached to the leader strip.

The first securing formation may be provided along the opposed edge of the leader strip or it may be spaced from such edge to provide a formation, such as a tab or flap, that may be gripped if desired.

Preferably, the drum is formed with a longitudinally extending peripheral recess that can accommodate the first and second securing formation, such that a substantially smooth surface of the drum is presented to a display sheet rolled on to it.

Preferably a further securing formation is provided along the edge of the leader strip that is attached to the drum, the further securing formation being engaged with the drum. The further securing formation may slidably engage longitudinally into a suitable undercut slot formation on the periphery of the drum. This construction facilitates assembly of the drum and leader strip, the drum thereafter being inserted into the housing and the spring tensioned. The further securing formation may be bonded or otherwise secured to the drum since it need not be detachable from the drum after the drum has been installed in the housing.

Preferably the leader strip is of a strong, flexible sheet material, such as a suitable plastics, which may be reinforced with fibres as is known in the art.

Preferably the leader strip comprises a strip of flexible material with a rib extending substantially along each edge of the strip. The ribs may be substantially the same to facilitate assembly. The strip may be of moulded or extruded plastics with an integrally moulded rib along each edge.

Another aspect of the invention provides a method of attaching a display sheet to a retractable display apparatus comprising a housing, a drum journalled for rotation in the housing on which the display sheet is to be wound, and a slot in the housing through which a display sheet can be unwound from the drum against the action of a return spring, including the steps of:

- securing one edge of a leader strip to the drum, the leader strip being dimensioned to extend through the slot when the drum is unwound sufficiently and having a first securing formation substantially at its opposed edge;
- attaching the display sheet to a second securing formation; and
- engaging the first and second securing formations with each other when the first securing formation is outside the housing.

The first and second securing formations are elongate formations that are releasably engageable with each other by sliding one longitudinally into engagement with the other.

Further features, variants and/or advantages of the invention will emerge from the following non-limiting description of an example of the invention made with reference to the accompanying schematic drawings.

DESCRIPTION OF ILLUSTRATED EMBODIMENTS

Figure 1:
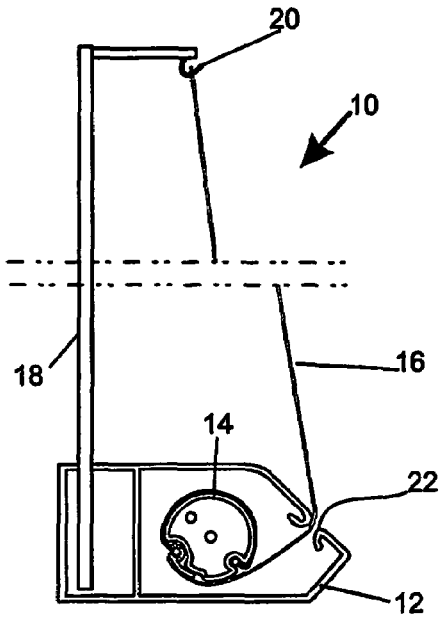
FIG. 1 shows a sectioned side view of a retractable display apparatus of the invention in use.

In the drawings the same or similar parts have the same reference numbers, certain parts having sub-numbers to identify them as part of a component or as substantially equivalent parts in different embodiments.

FIG. 1 shows a retractable display apparatus 10 comprising a housing 12 formed with a slot 22, a drum 14 journalled for rotation in the housing about an axis 14.1, a display sheet 16, a support post 18 removably mounted on the housing and a hook 20 for attaching the free end of the display sheet to the post. A coiled return spring, not shown, is provided inside the drum to wind the display sheet back onto the drum when the sheet has been extended from the housing. The housing has side walls, not shown, that rotatably support the drum.

Figure 2:
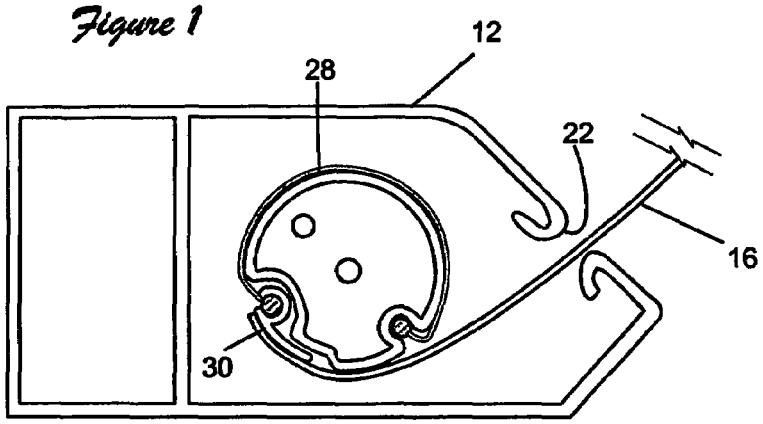
FIG. 2 shows a sectioned side view on a larger scale of a housing part of the apparatus for FIG. 1, a portion of a display sheet being shown partially wound onto a storage drum in the housing.
Figure 3:
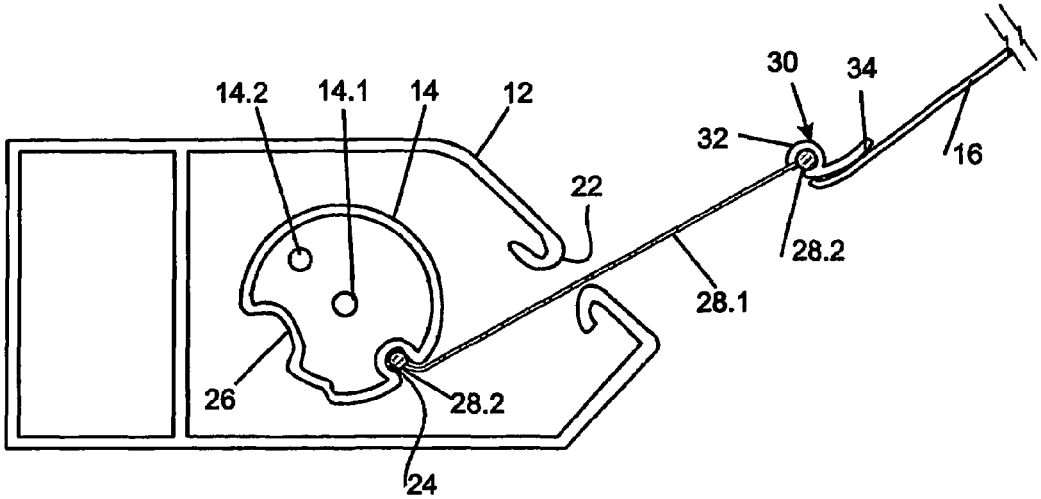
FIG. 3 shows a view similar to that of FIG. 2, with the display sheet and a leader strip fully unwound.

As best seen in FIGS. 2 and 3, the drum 14 is basically round and is formed with an undercut slot 24 and a recess 26. The drum is of extruded aluminium. The display sheet is attached to the drum by a leader strip 28 of extruded plastics, the strip comprising a flexible sheet 28.1 and a round rib 28.2 along each edge of the sheet 28.1. One of the ribs 28.2 is engaged in the slot 24 in the drum and the other forms a first securing formation. A second elongate securing formation 30 is bonded to the bottom edge of the display sheet, the second securing formation having an undercut formation 32 dimensioned longitudinally and releasably to receive a rib 28.2 of the leader strip and a curved portion 34 to which the display sheet can be bonded. The curvature of the curved portion 34 substantially matches that of the drum 14.

The securing formation 30 may be of extruded aluminium, in which event the display sheet would be adhesively bonded to it. Alternatively it may be of extruded plastics in which event it can be adhesively bonded to the display sheet or welded to the display sheet if the sheet is of suitable plastics.

The width of the leader strip is such that when it is wound onto the drum, see FIG. 2, the securing formation is substantially fully accommodated in the recess 26. Also the width is such that when fully unwound from the drum, the free rib 28.2 is outside the slot 22 where is it accessible to a user. The rib and securing formation 30 are dimensioned to pass freely through the slot 22.

A hole 14.2 is formed in an end wall or cap of the drum 14 and a hole is formed in an end wall of the housing to align with the hole 14.2. A pin, not shown, can pass through the two holes to hold the drum against rotation. This construction is well known in the art.

In practice the display sheet may be changed or replaced by pulling it fully out of the housing against the bias of the spring and then further to extend the leader strip outside the slot. A pin is passed through the registering holes in the drum and housing to hold the drum against rotation by the force of the spring. The securing formation 30 is then slid longitudinally out of engagement with the rib. A new display sheet with a securing formation secured to it is then slid into engagement with the rib, whereafter the pin is removed and the display sheet allowed to be wound onto the drum by the force of the return spring.

The invention is not limited to the precise details described above and shown in the drawings. Modifications may be made and other embodiments developed without departing from the spirit of the invention.

The invention claimed is:

1. A retractable display apparatus comprising a housing, a drum journalled for rotation in the housing, a display sheet wound on to the drum, and a slot in the housing through which the display sheet can be unwound from the drum against the action of a return spring, wherein a leader strip includes first and second edges and is attached to the drum along the first edge, the leader strip being dimensioned to extend through the slot when the drum is unwound sufficiently;

a first securing formation is provided on the leader strip spaced from the first edge, the first securing formation being dimensioned to pass through the slot; and a second securing formation is attached to the display sheet, the first and second securing formations being releasably engageable with each other.

2. The apparatus of claim 1, wherein the first securing formation is provided along the second edge of the leader strip.

3. The apparatus of claim 1, wherein the first securing formation is spaced from the second edge of the leader strip to provide a formation that may be gripped.

4. The apparatus of claim 1, wherein the drum is formed with a longitudinally extending peripheral recess that can accommodate the first and second securing formations, such that a substantially smooth surface of the drum is presented to a display sheet rolled on to it when such first and second securing formations are so accommodated.

5. The apparatus of claim 1, wherein a further securing formation is provided along the edge of the leader strip that is attached to the drum, the further securing formation being engaged with the drum.

6. The apparatus of claim 5, wherein a suitable longitudinally extending undercut slot is formed on the periphery of the drum and the further securing formation is slidable longitudinally into engagement with the undercut slot.

7. The apparatus of claim 5, wherein the further securing formation is secured to the drum.

8. The apparatus of claim 1, wherein the leader strip is of a strong, flexible sheet material.

9. The apparatus of claim 1, wherein the leader strip comprises a sheet and an integral rib extending longitudinally along each edge of the sheet.

10. The apparatus of claim 9, wherein the ribs are substantially the same.

11. The apparatus of claim 1, wherein the leader strip is made of plastic with an integral rib along each edge.

12. A method of attaching a display sheet to a retractable display apparatus comprising a housing, a drum journalled for rotation in the housing on which the display sheet is to be wound, and a slot in the housing through which the display sheet can be unwound from the drum against the action of a return spring, including the steps of:

a) securing one edge of a leader strip to the drum, the leader strip being dimensioned to extend through the slot when the drum is unwound sufficiently and having a first securing formation substantially at its opposed edge;

b) attaching the display sheet to a second securing formation; and c) engaging the first and second securing formations with each other when the first securing formation is outside the housing.

13. The method of claim 12, including the step of sliding the first and second securing formations longitudinally into engagement with each other.

14. An apparatus according to claim 3, wherein: said formation is one of a tab and a flap.

15. A retractable display apparatus for use with a display sheet, comprising:

a) a housing defining a slot;

b) a drum journalled for rotation in the housing;

c) a leader strip having first and second opposed edges, and attached to the drum along said first edge, the leader strip being dimensioned to extend through the slot when the drum is sufficiently unwound;

d) a first securing formation provided on the leader strip at the second edge, the first securing formation being dimensioned to pass through the slot; and e) a second securing formation for attachment to the display sheet.

16. An apparatus according to claim 15, wherein: the first and second securing formations are releasably engageable with each other.

17. An apparatus according to claim 15, wherein:

the drum includes a return spring, and the display sheet is wound on to the drum, the display sheet capable of being unwound from the drum against the action of the return spring and pulled through the slot.

* * * * *